US005829801A

United States Patent [19]

Tindall

[11] Patent Number: 5,829,801

[45] Date of Patent: Nov. 3, 1998

[54] LATCH MECHANISM

[75] Inventor: Melvyn Tindall, Oldham, Great Britain

[73] Assignee: Tindall Engineering Limited, United Kingdom

[21] Appl. No.: 708,463

[22] Filed: Sep. 5, 1996

[51] Int. Cl.[6] ..... E05B 3/00

[52] U.S. Cl. ..... 292/336.3; 292/92; 292/170

[58] Field of Search ..... 292/336.3, DIG. 37, 292/92, 165, 170

[56] References Cited

U.S. PATENT DOCUMENTS

| | | | |
|---|---|---|---|
| 917,685 | 4/1909 | Voight | 292/92 |
| 1,025,102 | 4/1912 | Voight | 292/92 |
| 1,081,036 | 12/1913 | Grandits | 292/165 X |
| 3,897,092 | 7/1975 | Atkins | 292/336.3 X |

FOREIGN PATENT DOCUMENTS

| | | | |
|---|---|---|---|
| 4671 | of 1906 | United Kingdom | 292/92 |

*Primary Examiner*—Rodney M. Lindsey
*Attorney, Agent, or Firm*—Thomas W. Tolpin

[57] ABSTRACT

A latch mechanism comprising pushing means (28) which may operate vertically. The pushing means (28) being operable to push a first lever (42) which is positioned to act upon a second lever (50). The second lever (50) operates to turn a spindle (53). The turning the spindle effects retraction of a locking mechanism associated with the spindle. The latch mechanism may be used to operate deadlocks and security locks.

10 Claims, 2 Drawing Sheets

LATCH MECHANISM

Figure 1A:
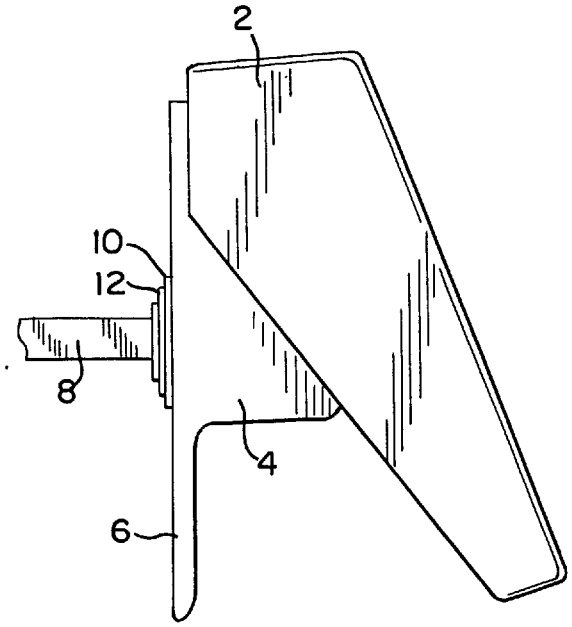

This invention relates to a Later Machanism

Specialist lock manufacturers have developed a range of deadlocks specifically designed to emergency exit escape doors. There have been various techniques employed for operating these emergency exit deadlocks and security locks without the use of a key. For instance, the use of "break glass" or "break dome" systems. The systems allow, once the glass has been broken, to turn the lock by use of simple thumb mechanism. Unfortunately, in public places such a convoluted method of escape is undesirable. In particular, in a situation where users could not be expected to be familiar with the lock mechanism of the building such systems are unacceptable. Examples of such buildings would include general or public buildings such as departmental stores, shopping centres, local authority buildings, restaurants, sports halls, leisure centres, schools, colleges, universities, sheltered accommodation etc.

A preferred exit system for use in the event of an emergency in such buildings is a full width push plate or pad which will release the looking mechanism and which can be operated by any part of the body in the event of a surge of people evacuating the building. Unfortunately, the currently available full width push plates and pads cannot operate a deadlock or security lockset and generally only satisfy the fire and safety standards but not necessarily the security requirements of the building. There have been attempts to produce more secure emergency exit mechanisms but these have been withdrawn through non-performance. In addition, none of these products could be mounted "vertically". "Vertically" means that the pivoting axis of the push plate or pad lies above that portion of the push plate or pad which is pushed by the user. Previous devices have been "horizontal". "Horizontal" means that the pivoting axis of the push plate lies to the left or right of that portion which is pushed by the user.

U.S. Pat. No. 3,897,092 provides a lever operated door latch opener which, although similar to the present invention, suffers from the drawback of not being able to have a downward operation on the door handle as well as a downward thrust on an inner lever which operates the lock, in combination with the device being mounted vertically on a door.

Thus, as one of its objects, the present invention has a push plate which operates vertically and with high security deadlock or security locks. A further object of the present invention is to provide a push plate or pad which will operate with approved and industry standard deadlocks and security locks.

A further object of the present invention is to provide a latch mechanism which provides for a convenient exit for disabled persons and also an alternative to the normal lever door handle in domestic situations. The invention may also be used with an ordinary casement lockset.

According to the present invention there is provided a latch mechanism comprising pushing means, said pushing means being operable to push a first lever, said first lever being positioned so as to act upon a second lever, said second lever being operable to turn a spindle, the said turning of the spindle effecting retraction of a locking mechanism associated with the said spindle wherein the first lever acts substantially downwardly upon the second lever to effect the said turning of the spindle and the pushing action of the said pushing means is a substantially downward movement.

Typically, said pushing means is a push plate, push bar or push pad.

Preferably, the portion of the second lever upon which the first lever acts is positioned on the side of the spindle most remote from the opening edge of a door to which the latch mechanism is attached.

Typically, the said first lever is urged under the force of the back plate of the pushing means and pivots about an axis located on the remote side of the second lever, with respect to the pushing means and the first lever has an arm extending from the pivot to the said second lever, a portion of said arm being operable to act downwardly upon the second lever.

Typically, for the performance of the operation of the mechanism the interaction of the said arm and second lever is by way of both a pushing and sliding motion.

Preferably, the said sliding motion takes place along the said arm in the direction of the first lever pivot. Additionally, the first lever may slide along the pivot thereof so as to prevent translational movement of the position of the said first lever with respect longitudinally to the second lever during downward turning of the first lever.

Thus the invention provides a unique leverage of the latch mechanism. In particular, the reverse action of the first lever to the second lever ensures the correct turning motion is achieved for the lock set. In addition, the working surfaces may have a unique simultaneous sliding, pushing and turning motion. The working surfaces comprising, the first lever, the second lever and the lever pivot.

A particular advantage of the invention is that it allows a substantially vertical pushing means operation for retracting a deadlock and/or a security lock.

Thus, preferably, the said spindle engages a dead lock security lock. The invention thus provides a unique solution to the problems associated with such locks and, in particular, avoids the necessity to have locksets made with a larger backset so that the standard upwardly acting levers can be used. Furthermore, the invention, thus provides a single device for use with a lockset irrespective of the length of the lockset.

The invention may be used to operate locksets fitted with locking cylinders. The invention may also be used with industry standard security lock sets.

According to a second aspect of the present invention there is provided a method of retracting a lockset comprising the following step:

a) depressing a pushing means wherein the pivotal axis of the pushing means is positioned above the portion thereon to be pushed.

The said lockset may have a deadlock. In addition, the lockset may have a deadbolt or dead-latch. Additionally, the lock set may have a bevel latch. Alternatively, the lockset may have any suitable combination of locking and latching features.

Preferably, the lock set described for use in relation to the above two mentioned aspects of the invention are five or more lever security dead locks and they also are typically fitted with a spring loaded bevel latch and an additional oblong shaped dead bolt or dead latch.

However, the invention is suitable for use with less than five lever security deadlocks or with the currently planned electronic and digitial locks or with any suitable locking mechanism.

Figure 1B:
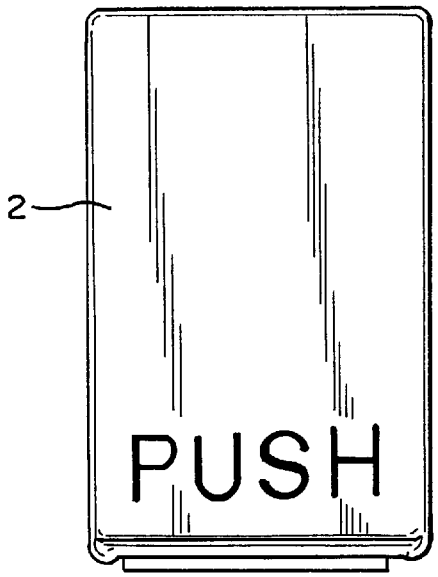
Figure 1C:
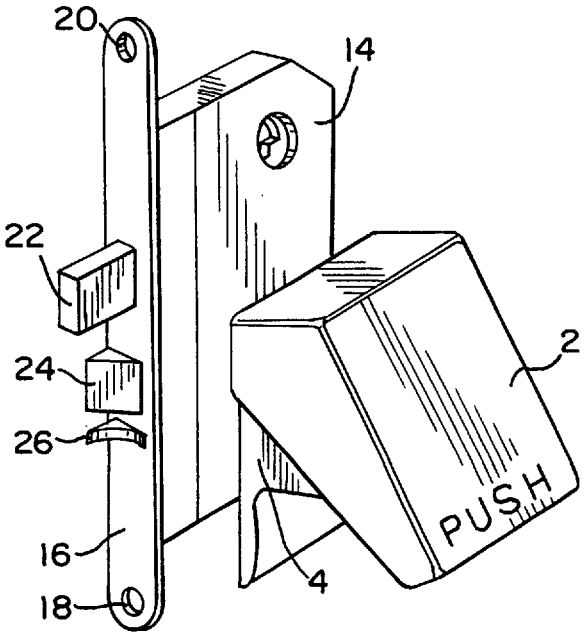
Figure 2A:
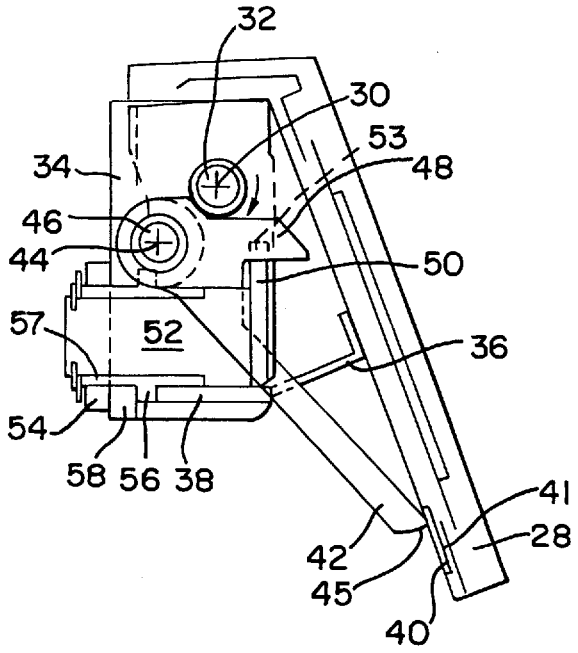
Figure 2B:
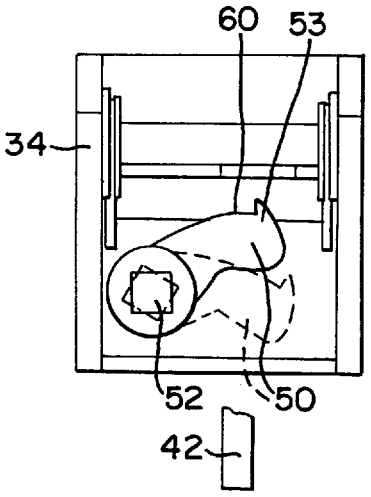

Embodiments of the invention will now be described by way of example only and with reference to the accompanying drawings in which:

FIG. 1*a* shows a side view of a push pad together with a lock set spindle,

FIG. 1*b* shows a front view of a push pad,

FIG. 1*c* shows a perspective view of a push pad and lock set,

FIG. 2*a* shows a cross-sectional side view of a latch mechanism,

FIG. 2*b* shows a partial cross-sectional front view of a latch mechanism.

Referring to FIG. 1*a* a push pad 2 which pivots about an axis toward the upper surface thereof (not shown) overhangs a close fitting inner casing 4. The inner casing 4 has a back plate 6 for securement to a door which said back plate accommodates a spindle 8. The said spindle is secured in position by a nut and washer 10 and 12.

Referring to FIG. 1*c* the position of the push plate 2 and inner casing 4 with respect to a lock mechanism 14 is shown. The push plate 2 and casing 4 are spaced from the opening edge of the door (not shown). The brace 16 is secured to the leading edge of the door by way of screws passing through apertures 18 and 20 located at either end of the said vertically extending securing plate. The lock set 14 has a dead lock 22 a bevel latch 24 and a lever 26 each spaced vertically from each other and designed to be close fitting with accommodating apertures in the security plate 16. The lever 16 engages the anti-thrust mechanism of the bevel latch 24.

Referring to FIG. 2*a* a push plate 28 pivots upon an axis 30 by means of a spindle 32 fixed to the sides of the push plate (not shown). A push plate 28 is secured by the said spindle 32 around an inner casing 34. The push plate has a shielding means 36 secured to the inner surface thereof which said shielding means protrudes perpendicularly from the said inner surface to be accommodated during pivotally inward movement of the push plate by a slit 38 proximal to the lower side of the casing 34. The inner surface of the push plate has a recessed portion 40 for slidably engaging a lever 42 at one end thereof. The shielding means 36 prevents the user placing fingers etc within the mechanism. The lever 42 pivots on a spindle 46 under the force of the push plate which slidably engages the remote end 45 of the lever 42 with respect to the spindle 46. The lever 42 has an arm 48 which extends perpendicularly from the spindle 46 in the direction of the push plate 28 when the latter is at rest. The upper surface of the said arm 48 has an upwardly chamfered surface proximal to the spindle 46 which partially engages the circumference of the spindle 32 and passes tangentially below the said spindle 32. The lower surface of the arm 48 engages the upper surface of a second lever 50 which said second lever has a lip 53 for engaging the side of the arm 48 distal to the lock set (not shown). The second lever 50 is secured to one end of the lockset spindle 52 which lockset spindle is secured to casing 34 by way of nut 54 on the door engaging surface of the casing and abutting circumferential lip 56 which abutts onto the inner surface of the casing 34. The lip 56 forms part of a bearing 57 which extends longitudinally from the front to the rear of the spindle at which rearward end the nut 54, secures the said bearing 57.

The recessed groove 40 accommodates a metal insert 41. The action of the metal insert 41 is to slidably engage the lever 42 when the outer surface of the push plate 28 is pressed causing pivotal movement of the lever 42 about the axis 44 of the spindle 46 and downward movement of the arm 48 about the axis 44 of the spindle 46. The metal insert assists the lever 42 in the sliding and turning motion thereof and is thus comprised of an appropriate material. Additionally, the insert 41 reduces wear at the contact points. The arm 48 downwardly engages the second lever 50 on the far side of the lock set spindle 52 so as to cause the lock set spindle 52 to rotate under the impulse of the downwardly moving second lever 50. In this manner the lock set of the door not shown) is retracted by a vertically downward movement of the push plate 28 which rotates above axis 30 of spindle 32.

A push plate 28 is designed to be close fitting with the casing 34 so that rotated movement of the push plate 28 around axis 30 of spindle 32 is not hindered by said casing 34. The lever 42 is disposed rearwardly of the longitudinal axis of the spindle 52 with respect to the lock set (not shown). The position of the lever 42 and spindle 52 is such that the lever only engages the second lever 50 of the lock set spindle 52 and is otherwise free to rotate about axis 44 of spindle 46 in a downward manner.

Referring to FIG. 2*b* two positions of the lock set spindle 52 and second lever 50 are shown. The continuous line drawing shows the position of the spindle and second lever at rest. The second lever 50 distally extends with respect to the lock set (not shown) in to the interior of the casing 34 the arm 50 has a lip 53 for engaging the side of the lever (not shown) and a flat upper surface 60 which slidably engages the lower surface of the lever arm 48 (not shown). The lever arm 48 acts downwardly upon the second lever 50 so as to move it to the second position shown by the dotted line which thereby causes the spindle 52 to rotate to a respective second position again shown by a dotted line. The position of the lever with respect to the second lever 50 is shown by the partial view of the lever 42. The lever 42 is positioned so as to engage the upper engaging surface 60 of the second lever 50 when the letter is at rest. During movement of the lever arm 48 downwardly the relative positions of the lever arm 48 and the second lever 50 alter in such a manner that the lever arm 48 and second lever 50 slidably engage each other along the length of the lower surface of the arm 48 and, simultaneously, the lever 42 travels along the pivot bar 44 away from the square spindle 52 so as to remain in engagement with the surface 60 and lip 53. The lip 53 also prevents upwardly rotating movement of the second lever 50 by abutment of the said lip 53 against the lever arm 48.

It will be appreciated that the invention can be used with any lock set where rotation of the lock set spindle is required to retract the locks of the door, window etc. However, the invention is best utilised where a second lever or lever distally extending with respect to the opening edge of the door is to be downwardly rotated in order to retract the locking means of the said door. In particular, the invention is particularly useful when the distance between the lock set spindle and the opening edge of the door is such that an industry standard upwardly acting lever cannot be positioned there without overlapping the opening edge and hindering the opening of the door/window etc. Thus, the invention is, particularly, useful and avoids the necessity to extend the lockset back from the leading edge of the door so that the said industry standard levers can be fitted.

Various modifications and variations to the embodiments of the invention as described are envisaged. For instance, the push plate or pad pivot bar may have the dual purpose of pivoting the push plate, or pad and accommodating the lever of the same type as the lever 42. Alternatively, the lever pivot bar may also act as the push plate or push pad pivot bar.

I claim:

1. A latch mechanism comprising: downward pushing means, said pushing means being operable to downwardly push a first lever, said first lever extending from one end at a pivot to a free end and having an engagement portion positioned so as to act upon a second lever, said second lever being operable to turn a spindle, the said turning of the spindle effecting retraction of a locking mechanism associated with the said spindle wherein the first lever acts substantially downwardly upon the second lever to effect the said turning of the spindle and the pushing action of the said downward pushing means is a substantially downward movement.

2. A latch mechanism as claimed in claim 1, characterized in that the said downward pushing means is selected from the group consisting of a push plate, push bar, and push pad.

3. A latch mechanism as claimed in claim 1, characterized in that a portion of the second lever upon which the first lever acts is positioned on the side of the spindle from being most remote from an opening edge of the door to which the latch mechanism is attached.

4. A latch mechanism as claimed in claim 1, characterized in that the first lever is urged under the force of the downward pushing means and pivots about an axis located on a remote side of the second lever with respect to the downward pushing means and the first lever has an arm extending from a pivot to the second lever, a portion of said arm being operable to act downwardly upon the second lever.

5. A latch mechanism as claimed in claim 1, characterized in that the first lever is urged under the force of the downward pushing means and pivots about an axis located on a remote side of the second lever with respect to the downward pushing means and the first lever has an arm extending from a pivot to the second lever, a portion of said arm being operable to act downwardly upon the second lever and wherein the interaction of the said arm and second lever is by way of both a pushing and sliding motion.

6. A latch mechanism as claimed in claim 1, characterized in that the first lever is urged under the force of the downward pushing means and pivots about an axis located on a remote side of the second lever with respect to the downward pushing means and the first lever has an arm extending from a pivot to the second lever, a portion of said arm being operable to act downwardly upon the second lever and wherein the interaction of the said arm and second lever is by way of both a pushing and sliding motion, said sliding motion takes place along the said arm in the direction of the first lever pivot, and the first lever slidably engages the second lever so as to prevent translational movement of a position of the said first lever with respect longitudinally to the second lever during downward turning of the first lever.

7. A latch mechanism as claimed in claim 6, characterized in that the reverse action of the first lever to the second lever ensures a correct turning motion is achieved for a locking mechanism.

8. A latch mechanism as claimed in claim 1, characterized in that the downward pushing means of the latch mechanism includes means for retracting at least one deadlock or security lock, and wherein the downward pushing means has a pivoting axis above a portion of the downward pushing means which is pushed by a user.

9. A latch mechanism as claimed in claim 1, in combination with a lockset fitted with at least one lock selected from the group consisting of a deadlock, dead-bolt, and dead-latch, and in which the lockset is operated by said latch mechanism.

10. A latch mechanism as claimed in claim 1, in combination with a lockset fitted with at least one latch selected from the group consisting of a spring loaded bevel latch, an oblong shaped dead-bolt, and a dead-latch.

* * * * *